US008863625B2

(12) United States Patent
Busby et al.

(10) Patent No.: US 8,863,625 B2
(45) Date of Patent: Oct. 21, 2014

(54) ELASTOMERIC GASKET SQUEEZE OUT REMOVAL METHOD AND KIT

(75) Inventors: Jeffrey D. Busby, Millsap, TX (US); Douglas J. Smith, Weatherford, TX (US)

(73) Assignee: Aviation Devices & Electronics Components, LLC, Fort Worth, TX (US)

( * ) Notice: Subject to any disclaimer, the term of this patent is extended or adjusted under 35 U.S.C. 154(b) by 310 days.

(21) Appl. No.: 13/528,221

(22) Filed: Jun. 20, 2012

(65) Prior Publication Data

US 2013/0000453 A1 Jan. 3, 2013

Related U.S. Application Data

(60) Provisional application No. 61/499,412, filed on Jun. 21, 2011.

(51) Int. Cl.

| | |
|---|---|
| ***B26D 3/00*** | (2006.01) |
| ***B26B 27/00*** | (2006.01) |
| ***B26B 9/00*** | (2006.01) |
| ***B26D 7/08*** | (2006.01) |

(52) U.S. Cl.
CPC .... *B26B 9/00* (2013.01); *B26D 7/08* (2013.01)
USPC ..... 83/22; 83/169; 83/109

(58) Field of Classification Search
USPC ..... 83/22, 169, 109; 524/474, 487, 543; 156/71, 247, 249, 289; 15/235.7, 15/236.07, 245, 105.2
See application file for complete search history.

(56) References Cited

U.S. PATENT DOCUMENTS

| | | | | |
|---|---|---|---|---|
| 1,851,948 | A | | 3/1932 | Summers |
| 2,092,393 | A | | 9/1937 | Hewitt |
| 2,481,760 | A | * | 9/1949 | Leher ..... 392/476 |
| 3,126,440 | A | | 3/1964 | Goodloe |
| 3,473,813 | A | | 10/1969 | Meyers |
| 3,532,349 | A | | 10/1970 | Czernik |
| 3,542,939 | A | | 11/1970 | Mintz |
| 3,555,168 | A | | 1/1971 | Frykberg |
| 3,679,059 | A | * | 7/1972 | Wyatt et al. ..... 210/321.61 |
| 3,681,272 | A | | 8/1972 | Gloskey |
| 3,993,833 | A | | 11/1976 | Esmay |

(Continued)

FOREIGN PATENT DOCUMENTS

| | | | |
|---|---|---|---|
| JP | 09109346 | A | 4/1997 |
| WO | WO 2005/030893 | | 4/2005 |

OTHER PUBLICATIONS

Loos & Co., Inc., Knitted Wire Mesh, www.loosco.com/index.php?page=knitted-wire-mesh, 3 pages Dec. 7, 2012.

(Continued)

*Primary Examiner* — Ghassem Alie
(74) *Attorney, Agent, or Firm* — Jackson Walker, LLP

(57) ABSTRACT

A method is disclosed for trimming elastomeric gasket squeeze-out from between a removeable workpiece and a static base, when there is compression between the workpiece and the base. The elastomeric gasket is deformable and compression causes squeeze-out along the edge. The method comprises using a tack release agent to remove the tackiness from the elastomeric squeeze-out and, following wetting of the squeeze-out, applying a thin blade adjacent the workpiece and trimming the excess squeeze-out by moving the blade along the workpiece.

6 Claims, 3 Drawing Sheets

(56) References Cited

U.S. PATENT DOCUMENTS

| | | | | |
|---|---|---|---|---|
| 4,037,009 | A | 7/1977 | Severinsen | |
| 4,090,988 | A | 5/1978 | Babiec | |
| 4,183,699 | A | 1/1980 | Donan | |
| 4,325,280 | A | 4/1982 | Hardy | |
| 4,544,169 | A | 10/1985 | Cobb | |
| 4,628,783 | A * | 12/1986 | Brownell et al. | 83/862 |
| 4,635,949 | A | 1/1987 | Lucas | |
| 4,768,254 | A * | 9/1988 | Bell | 15/236.01 |
| 4,835,060 | A | 5/1989 | Kosiarski | |
| 4,900,629 | A | 2/1990 | Pitolaj | |
| 4,900,877 | A | 2/1990 | Dubrow | |
| RE33,392 | E | 10/1990 | Brauer | |
| 5,037,879 | A | 8/1991 | Roberts | |
| 5,158,638 | A | 10/1992 | Osanami | |
| 5,512,709 | A | 4/1996 | Jencks et al. | |
| 5,702,111 | A | 12/1997 | Smith | |
| 5,791,654 | A | 8/1998 | Gaines et al. | |
| 5,890,719 | A | 4/1999 | Bettencourt | |
| 5,910,524 | A | 6/1999 | Kalinoski | |
| 5,929,138 | A | 7/1999 | Mercer et al. | |
| 5,957,606 | A * | 9/1999 | Jafarmadar | 401/140 |
| 6,056,526 | A | 5/2000 | Sato | |
| 6,121,545 | A | 9/2000 | Peng | |
| 6,346,330 | B1 | 2/2002 | Huang et al. | |
| 6,364,976 | B2 | 4/2002 | Fletemier | |
| 6,365,812 | B1 | 4/2002 | McGill | |
| 6,403,226 | B1 | 6/2002 | Biernath et al. | |
| 6,530,577 | B1 | 3/2003 | Busby | |
| 6,553,664 | B1 | 4/2003 | Schenk | |
| 6,695,320 | B2 | 2/2004 | Busby | |
| 7,229,516 | B2 | 6/2007 | Busby | |
| 7,290,769 | B2 | 11/2007 | Plona | |
| 7,314,898 | B2 | 1/2008 | Downing, Jr. et al. | |
| 7,654,538 | B2 | 2/2010 | Oka | |
| 8,691,033 | B1 * | 4/2014 | Busby et al. | 156/71 |
| 2002/0135137 | A1 | 9/2002 | Hammi | |
| 2005/0023768 | A1 | 2/2005 | Adams | |
| 2009/0322040 | A1 | 12/2009 | Banba | |
| 2010/0258200 | A1 | 10/2010 | Walker | |
| 2011/0156353 | A1 | 6/2011 | Kabutoya et al. | |

OTHER PUBLICATIONS

"Conductive Elastomer Gasket Design," Chomerics, www.chomerics.com, pp. 1-9.

"Technical Data Sheet," PNE 1500101130CR, VTT/Shieldex Trading USA, www.shieldextrading.net/product_INDEX.html.

Tecknit, EMI Shielding Products, Mesh & Elastomer Combination Gaskets, www.tecknit.com/meshelas.html.

Tecknit, EMI Shielding Products, Oriented Wire Mesh Strip & Gasket Material, www.tecknit.com/orient.html.

Tecknit, EMI Shielding Products, Conductive Silicone Elastomers, www.tecknit.com/silelast.html.

* cited by examiner

ELASTOMERIC GASKET SQUEEZE OUT REMOVAL METHOD AND KIT

This application claims the benefit of, priority to, and incorporates by reference U.S. Provisional Application Ser. No. 61/499,412, filed Jun. 21, 2011.

FIELD OF THE INVENTION

Gasket cleanup, more particularly, cleanup of gasket material that has squeezed out, when the gasket is under compression between a workpiece and a base.

BACKGROUND OF THE INVENTION

Gaskets are typically used, under compression between a base and a workpiece, to help provide an environmental seal between the two pieces. Some gaskets are made from an elastomeric material, such as a cured polyurethane gel, that is subject to deformation and squeeze-out when under compression.

When such a gasket is placed between a workpiece and a base, and is compressed therebetween, there may be, if the compression is sufficient, some squeeze-out along the outer edges of the workpiece. Often, this is not a problem and does not alter the effectiveness of the seal. However, aesthetically it may be considered a problem in some cases.

In one area, in particular, the aesthetic issues may call for the removal of the squeeze out beyond the edge of the workpiece. This is true, for example, where the elastomeric gasket is used between a base comprising the outer skin of the fuselage of an aircraft and a workpiece which is intended to be placed on the outer skin of the aircraft under compression, for example, an antenna. In such case, some aircraft manufacturers indicate that squeeze-out removal is required for aesthetic purposes.

SUMMARY OF THE INVENTION

Applicants provide a kit and a method for tacky elastomeric gasket squeeze-out removal. In one exemplary embodiment, Applicants provide for the removal of a tacky (to the touch) polyurethane gasket material squeezed-out from between an aluminum aircraft fuselage outer skin base and a workpiece accessory attached thereto, such as an antenna.

Applicants provide a method of trimming elastomeric gasket squeezed-out from between a workpiece and a base, the method comprising steps of providing a release agent and a delivery device for delivering a controlled quantity of release agent; providing a tool having a thin blade with a blade tip, applying the release agent to the squeeze-out, placing the blade substantially flush against the workpiece edge with the tip against the base, moving the tool with the blade against the workpiece edge and the tip against the base, along the workpiece perimeter as the squeeze-out accumulates on the base, and periodically removing the squeeze-out from the base and/or the blade.

A kit is provided for trimming elastomeric gasket squeezed-out from between a workpiece and a base, the kit comprising a liquid tack release agent, typically comprising an alcohol, a release agent spray container; and a release agent tool having a blade with a tip adapted to apply to the base and against the edge of the workpiece.

DETAILED DESCRIPTION OF THE PREFERRED EMBODIMENT

U.S. Pat. Nos. 6,530,577; 6,695,320; and 7,229,516 are incorporated herein by reference. In these patents, an elastomeric gasket is described that is comprised of an elastomeric body typically having a skeletal member, such as a wire mesh or other suitable, typically flexible member embedded therein. In one exemplary embodiment of Applicants' method, system, and kit as set forth herein, this particular gasket G is used. In this exemplary embodiment, the workpiece may be an antenna gasket or other removable aircraft part, and the base may be the aluminum skin of the outer fuselage of an aircraft or other static aircraft surface.

The setting in which Applicants' method and kit are used is typically one in which the gasket, here, for example, a sticky elastomeric gasket of hardness between about 95 and about 115, is placed between a base B and a workpiece WP, and placed under compression as, for example, by the tightening of fasteners F. Typically, torque will be applied to the fasteners, a period of time will commence, in which there will be some gasket deformation, including squeeze-out beyond the perimeter or edge of the workpiece. This may be in the order of magnitude of ten to thirty minutes. At this time, squeeze-out is usually substantially complete. The workpiece may then be re-torqued to specifications. A suitable applicator 10, filled with a liquid tack release agent 12, may be applied as a spray 12*a*, an aerosol, by brush or other suitable means. Tack releasing agent 12 is typically non-reactive with all parts of the assembly comprising the workpiece, gasket, and base. The workpiece and base are typically metallic, for example, aluminum.

The tack release agent is typically a liquid and may be atomized as by spraying or sprayed in a thin liquid stream, The tack release agent may be, in a preferred embodiment, isopropyl alcohol (99%) in one embodiment, which is especially useful for polyurethane elastomeric body gaskets, which are typically soft enough to generate squeeze-outs under deformation and compression. The step of spraying may be used to describe this step in one embodiment, but is understood to include any means of applying a release agent to the junction of the edge of the workpiece, the base, and the exposed gasket edge.

Figure 1B:
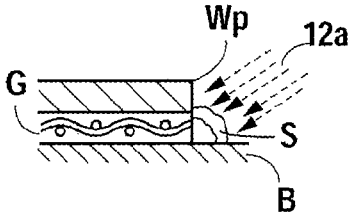
FIG. 1B is a partial cross-sectional side view of the workpiece and base with a gasket compressed therebetween and squeeze-out emerging past the edge of the workpiece.
Figure 1A:
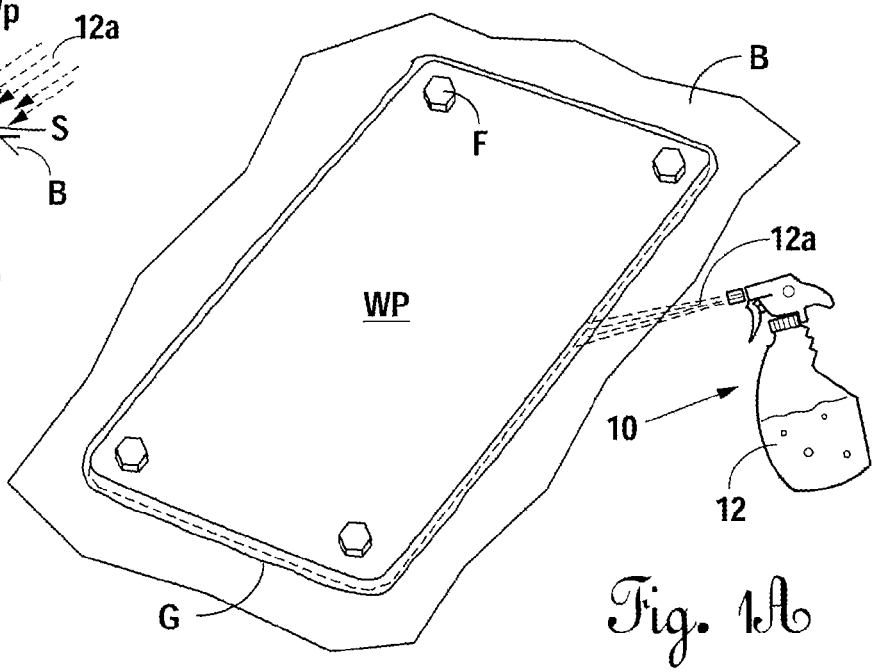
FIG. 1A is an isometric view of a workpiece and a base having a gasket under compression therebetween, with squeeze-out past the workpiece edge and illustrating the application of a release agent thereto.
Figure 2B:
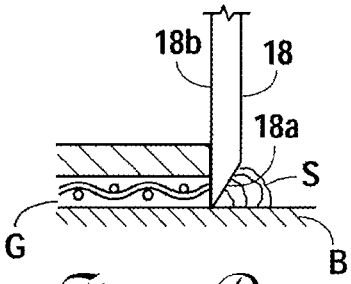
FIG. 2B is a partial cross-sectional view of the blade of a tool resting against the edge of the workpiece and removing therefrom squeeze-out.
Figure 2A:
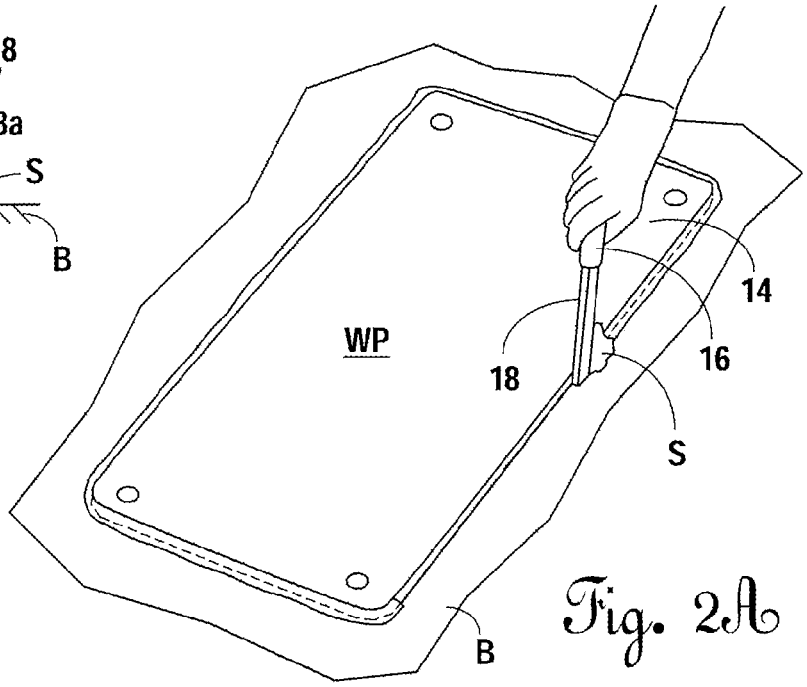
FIG. 2A is an isometric view of a workpiece and a base having a gasket under compression therebetween, with squeeze-out and illustrating the manner in which squeeze-out is removed therefrom.

In FIGS. 2A and 2B, after the squeeze-out has accumulated, a tool 14, typically having a handle 16 and, in one embodiment, a blade 18 (typically plastic), may be engaged, generally vertically adjacent and against the edge of the workpiece as seen in FIG. 2B, and held, typically at a slightly non-normal angle as indicated in FIG. 2A, and moved down along the perimeter P, as held, which edge has been wetted with the tack release agent 12. Typically, several swipes of tool 14 may be taken, and the squeeze-out S is manually removed from the tool, with a gloved hand or a release agent dampened cloth. Spray 12*a* may be re-applied as necessary between swipes if gasket "pullout" or stickiness is observed.

The appropriate tack release agent is one which renders the surface of the polyurethane or other gasket body that represents the squeeze-out S is substantially tack-free (at least while wet). That is to say, the squeeze-out, especially in the hardness range indicated, usually has a tackiness that will cause it to adhere to the workpiece, tool, and/or base or gasket body, and to "ball up." By spraying, especially the squeeze-out S, with a suitable tack release agent to remove the tackiness therefrom, there will be little or no pull-out along the edges as the tool is held and moved in the manner indicated.

Figure 6:
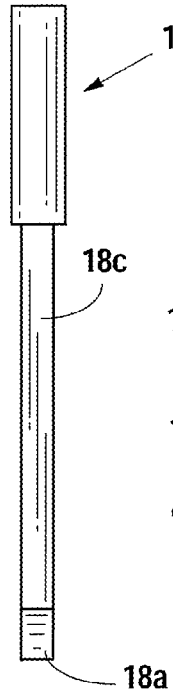

Typically, one section of the perimeter will be cleaned at a time, which section is properly wetted. Typically, the blade of the tool will come to a tip 18*a* as best seen in FIG. 6, and will be made of a material, such as plastic, which is softer than the material comprising base B. If the base B is the aluminum skin of an aircraft, a plastic putty knife will work. If the blade is too sharp or too much pressure is asserted, then the surface of the base may be marred, as by grooving, scratching or the like.

Typically, a few pounds of pressure is all that is needed in a downward direction and a very slight pressure urging blade 18 with edge 18*b*, especially a flat edge against the workpiece as seen in FIG. 2B.

Figure 3B:
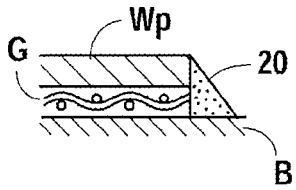
FIG. 3B illustrates in a partial cross-sectional view an area between the edge of the gasket and the workpiece and the exposed area adjacent thereto of the base in which a perimeter sealant has been added.
Figure 3A:
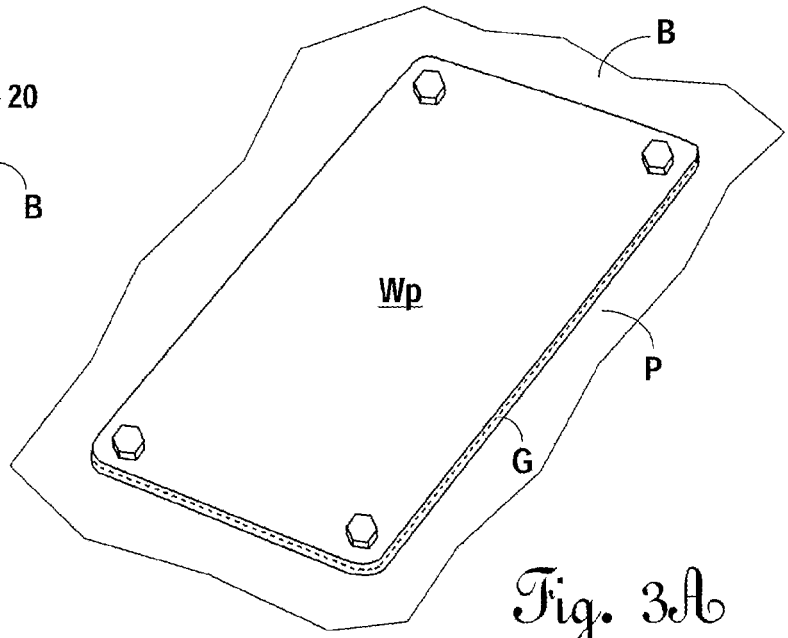
FIG. 3A is an isometric view of a workpiece and a base having a gasket under compression therebetween, with squeeze-out and illustrating the base and workpiece after the squeeze-out has been removed therefrom.
Figure 4:
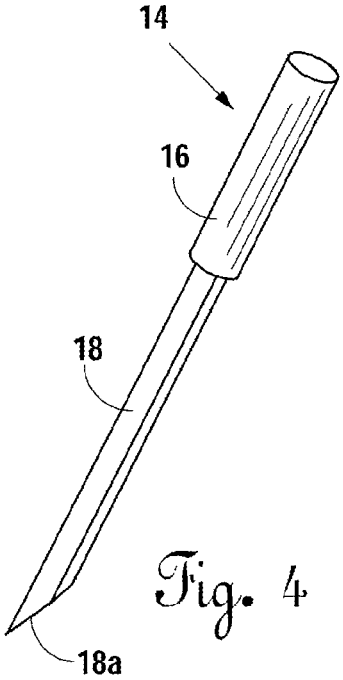
FIGS. 4, 5, 6, and 7 are various views of an embodiment tool that may be useful in the removal of squeeze-out as set forth herein.
Figure 5:
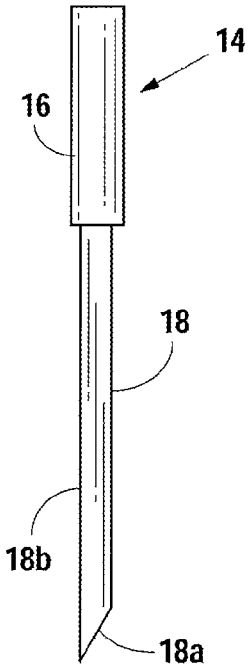

FIGS. 3A and 3B illustrate that when the squeeze-out removal is properly performed, the elastomeric material outside the workpiece edge (as projected downward to the base) is substantially removed.

An additional step following removal and the drying of any release agent may be the application of perimeter sealant 20, such as a polysulfide adhesive which is applied, after hand mixing the two parts, in a soft plastic state with a spatula, and may cure in place. Frozen synthetic rubber may also be applied with a heat gun. Both of these methods of application as known in the art to provide additional environmental sealing, aesthetics, and drag reduction. This will provide a seal, typically sealing the exposed edge of the gasket from exposure to the elements (see FIG. 3B). An appropriate perimeter sealant may be weather and UV resistant and hard.

Immediately after removal with tool 14, the perimeter P may be wiped with a release agent dampened cloth 22, such as cheesecloth, cotton or the like, to remove any excess squeeze-out still remaining.

Figure 7:
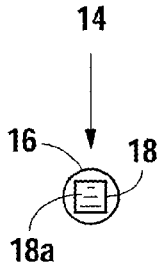
Figure 8:
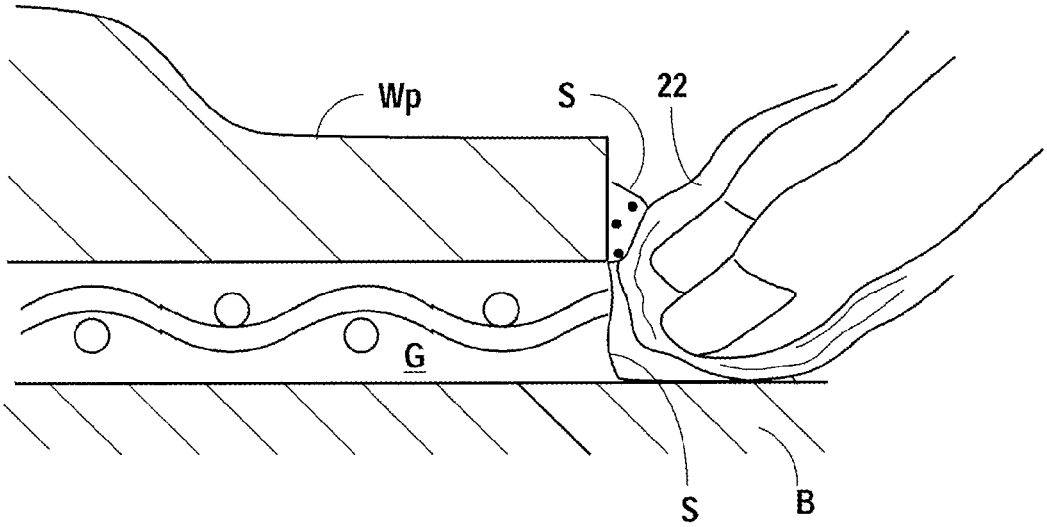
FIG. 8 illustrates an optional step of wiping down the squeeze-out with a clean damp cloth.

A kit comprising materials typically required for practicing Applicants' method may include a suitable tool, spray applicator with a liquid tack release agent and, optionally, a cheesecloth or other suitable fabric. In a preferred embodiment, the blade is square or rectangular in cross-section (see FIG. 7) and the tip is beveled to a tip edge 18*d*.

Isopropyl alcohol is an appropriate tack release agent, as is soapy water. In fact, any suitable surfactant may work. In a preferred embodiment, the blade is held in one hand and, in another hand, the spray bottle is sprayed with immediate movement of the blade of the tool across the just sprayed section of the squeeze-out. That is to say, the spray step is followed by an immediate swipe with the tool.

In a preferred embodiment, the perimeter of the workpiece is cleaned in sections. In other words, spray and cleaning of a first section will be completed before spraying and cleaning of a second section of the perimeter is done. In such a manner, the liquid release agent does not evaporate and is still wet on the exposed squeeze-out.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A method of trimming tacky polyurethane elastomeric gasket squeezed-out from between a workpiece and a base, the method comprising steps of:

providing a liquid tack release agent and a release agent delivery device for delivering a controlled quantity of release agent;

providing a tool having a blade with a blade tip;

applying the release agent to the squeeze-out;

placing the blade substantially flush against the workpiece perimeter with the tip gently against the base;

moving the tool with the blade against the workpiece perimeter and the tip against the base, along the workpiece perimeter as the squeeze-out accumulates on the base; and removing periodically the squeeze-out from the base and/or blade; wherein the tip of the tool blade is beveled; wherein the removing step includes wiping the perimeter with a cloth; and wherein the blade has a flat surface.

2. The method of claim 1, wherein the tool blade is plastic.

3. The method of claim 1, wherein the release agent is an alcohol.

4. The method of claim 3, wherein the alcohol is isopropyl alcohol.

5. The method of claim 1, wherein the placing and moving steps immediately follow the applying step.

6. The method of claim 1, wherein the tack release agent is soapy water.

* * * * *